United States Patent [19]

Fjeld

[11] Patent Number: 5,011,335

[45] Date of Patent: Apr. 30, 1991

[54] METHOD FOR MAKING FOUNDATION FOR A JACKABLE PLATFORM, AND MEANS FOR CARRYING OUT THE METHOD

[75] Inventor: Svein Fjeld, Oslo, Norway

[73] Assignee: Norwegian Contractos A/S, Stabekk, Norway

[21] Appl. No.: 299,991

[22] PCT Filed: May 13, 1988

[86] PCT No.: PCT/NO88/00042

§ 371 Date: Feb. 14, 1989

§ 102(e) Date: Feb. 14, 1989

[87] PCT Pub. No.: WO88/08902

PCT Pub. Date: Nov. 17, 1988

[30] Foreign Application Priority Data

May 14, 1988 [NO] Norway ..... 872007

[51] Int. Cl.[5] ..... E02B 17/00

[52] U.S. Cl. ..... 405/204; 405/196; 405/195

[58] Field of Search ..... 405/196, 226, 204, 205, 405/203, 197, 198; 114/265; 175/5–7

[56] References Cited

U.S. PATENT DOCUMENTS

| | | | |
|---|---|---|---|
| 2,210,408 | 8/1940 | Henry | 405/196 |
| 2,909,901 | 10/1959 | Suderow . | |
| 4,007,598 | 2/1977 | Tax | 405/204 X |
| 4,063,426 | 12/1977 | Hansen | 405/226 X |
| 4,431,345 | 2/1984 | Inoue | 405/196 X |
| 4,472,084 | 9/1984 | Boon | 405/196 X |
| 4,553,878 | 11/1985 | Willemse et al. | 405/204 X |

FOREIGN PATENT DOCUMENTS

| | | |
|---|---|---|
| 2065198 | 3/1979 | United Kingdom . |
| 2081782 | 8/1980 | United Kingdom . |
| 2071740 | 12/1980 | United Kingdom . |
| 2079826 | 4/1981 | United Kingdom . |
| 2180870 | 9/1985 | United Kingdom . |

*Primary Examiner*—Dennis L. Taylor

*Attorney, Agent, or Firm*—Wenderoth, Lind & Ponack

[57] ABSTRACT

A method and apparatus for positioning in the sea a buoyant platform having a plurality of legs which are movable relative to the platform. One or more tubular elements are detachably suspended from one or more of the legs, such that upon lowering of the legs relative to the buoyant platform, the tubular elements come into contact and rest on the sea bottom. The tubular elements are preferably detached from the legs and a filler material such as gravel is filled into the open ended tubular elements, thereby forming one or more foundations upon which the legs can rest so that the platform can be jacked upwardly relative to the legs and extend above the sea level.

15 Claims, 1 Drawing Sheet

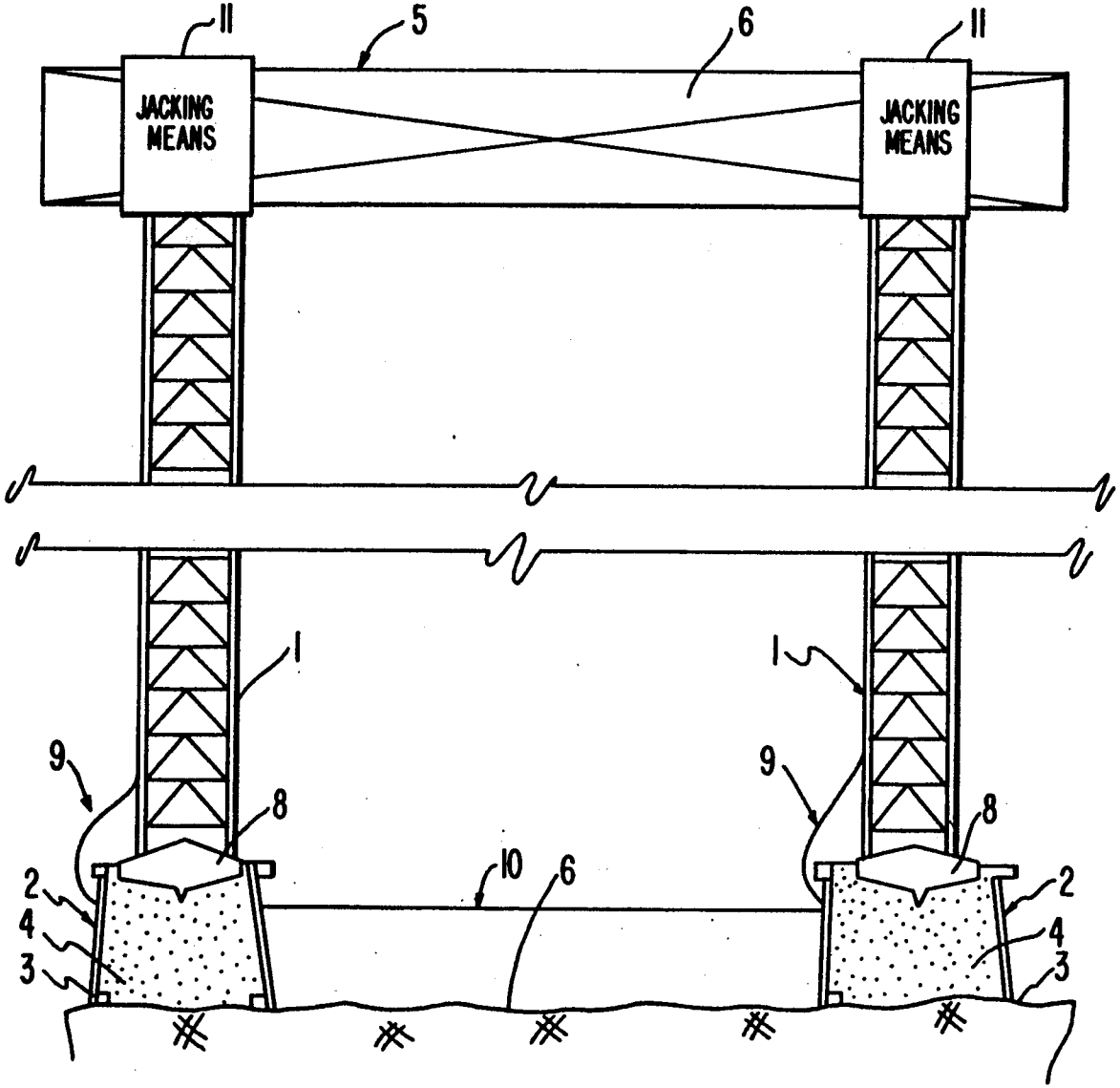
JACKING MEANS
JACKING MEANS
11
11
6
5
1
1
8
8
9
9
10
6
2
4
3
2
4
3

METHOD FOR MAKING FOUNDATION FOR A JACKABLE PLATFORM, AND MEANS FOR CARRYING OUT THE METHOD

BACKGROUND OF THE INVENTION

The present invention relates to a method for making a foundation for a jackable platform on a sea bottom. The platform comprises a preferably buoyant or self-floating deck, and a plurality of legs upon which the deck can be jacked up and/or down so that the platform can be moved or relocated by floating it to the desired location and then jacked up to a position above the sea surface as supported by the legs.

The present invention relates further to a means for making a foundation for a jackable platform of the before-mentioned type.

Existing platforms of the type described above possess inherent limitations in that the platform legs have limited length and strength. If such a platform is to be used in water which is deeper that the legs are designed for, the legs must be replaced and/or reinforced. Such an operation is both time consuming and expensive, especially since it would also require the mountings and/or the jack means on the deck as well as the deck structure to be modified.

SUMMARY OF THE INVENTION

In order to reduce the above-mentioned shortcomings and in order to facilitate a simple adaption of existing jackable platforms for use in depths greater than for which the platforms were designed, it is proposed in accordance with the present invention to detachably connect one or more tubular elements to the lower ends of the support legs. Upon submersion of the legs, the tubular elements will contact and partially penetrate the sea bottom. Thereafter, gravel or the like is supplied to the internal space in the tubular elements up to a predetermined level. The legs are then lowered (i.e., jacked downwardly) until they rest firmly on or partially penetrate into the supplied layer of gravel or the like contained in at least one of the tubular elements. Thereafter, the self-floating platform deck is jacked up to a desired level above the sea surface. The tubular elements can advantageously be suspended from the legs while the platform is located near the shore preferably in a protected area, and thus be towed out to the installation site along with the platform and legs. The tubular elements can, for example, be suspended from the legs by means of chains, cables or the like.

The cross-sectional area of the tubular elements should be greater than the cross-sectional area of the jackable legs. The upper and/or lower parts of the tubular elements should be open or at least partly open and the tubular elements can advantageously be conically shaped having a larger lower diameter than upper diameter.

The tubular elements should be movably suspendable from the platform legs. The tubular elements can further be mutually connected and spaced apart by reinforcement elements. The lower ends of the tubular elements can further be provided with a penetrating edge or a skirt body which is adapted to be pressed down into the sea bottom.

BRIEF DESCRIPTION OF THE DRAWING FIGURE

The present invention is further described below with reference to the accompanying drawing FIGURE which shows a partially schematic elevation view of an embodiment of a platform in accordance with the invention.

DETAILED DESCRIPTION OF THE INVENTION

The FIGURE shows a jackable platform 5 comprising a buoyant or self-floating deck structure 6 having at least three legs 1 (only two of which are shown). The legs 1 can be jacked up and/or down relative to the deck structure 6 in a conventional manner. Jacking means are shown schematically at 11 in the drawing FIGURE. The jacket means can be of any known type suitable for use with the jackable platform of the present invention.

The length of the legs 1 will impose a limitation on the water depth in which the platform can be used. In order to increase the depth in which a particular platform can be used, tubular elements 2 are provided as foundations below legs 1. The tubular elements 2 preferably have cylindrical or conical shapes. The tubular elements 2 may be formed as open, reinforced pipes made, for example, of steel or concrete. As shown in the FIGURE, the lower parts 3 of the tubular elements 2 can be adapted such that they penetrate the sea bottom 6 at the site installation, and such that they are otherwise designed so as to be used as foundation elements for the legs 1 of the platform.

The foundation elements are established by locating the tubular elements 2 in vertical position on the sea bottom, and filling and packing them up to a desired level with gravel, sand or the like suitably graded material 4.

The platform is installed in the following manner:

The required number of tubular elements are produced ashore and are thereafter submerged and located on the sea bottom at a selected mounting site. The tubular elements are positioned on the sea bottom such that they are spaced apart in a manner which corresponds to the spacing and relationship between the legs 1 of the platform. This spacing may be facilitated by the inclusion of reinforcement elements 10 between the tubular elements 2. The platform 5 is thereafter floated to a position in which the legs are spaced directly above the tubular elements. The tubular elements are then attached to the legs in a suitable manner by a suspending means 9 such as chains, cables or the like.

The legs are then lifted or jacked up from the sea bottom, thereby correspondingly lifting and suspending the tubular elements. With the tubular elements suspended from the legs, the platform is then towed out to the predetermined operational site. The tubular elements are correctly positioned on the sea bottom by moving the legs downwardly relative to the platform such that the lower ends of the tubular elements come in contact with the sea bottom.

The tubular elements are thereafter filled with sand, gravel or the like material. If necessary, the filling material can be compacted, for example, by alternately moving the legs up and down into and out of contact with the sand, gravel or the like material. In order to facilitate the filling of gravel or the like into the tubular elements, the platform legs can be detached from the tubular elements and jacked upwardly to provide a suitable spacing between the pipe elements and the legs. The filling material can be filled into the tubular elements in any known manner, including conventional manual and mechanized methods.

The legs are thereafter lowered down onto the foundation elements, whereafter the deck is jacked up to a position above the sea surface. Suitable footings 8 may be attached to the tubular elements.

When the platform is to be moved or relocated, the method or procedure described above is reversed. When the tubular elements are lifted up, the gravel or the like will pour out through the open bottom ends of the tubular elements and remain on the sea bottom.

I claim:

1. A method for positioning, in a sea, a platform having a buoyant deck and having a plurality of legs extending downwardly from said platform, said plurality of legs being movable vertically relative to said platform and being spaced apart from one another in a predetermined manner, comprising the steps of:

arranging at least one vertically oriented tubular element on the sea bottom at a position corresponding to a position at which at least one of said plurality of legs is desired to be located;

at least partially filling said at least one tubular element with a filling material;

lowering said at least one of said plurality of legs relative to said platform until a bottom end of said at least one of said plurality of legs presses against said filling material which was previously filled into said at least one tubular element; and raising said platform relative to said at least one of said plurality of legs so as to cause said platform to be elevated above the level of the sea.

2. A method as recited in claim 1, wherein said step of arranging at least one tubular element on the sea bottom comprises the steps of:

arranging said at least one tubular element on the sea bottom at a mounting location;

detachably connecting said at least one tubular element to said at least one of said plurality of legs;

raising said at least one of said plurality of legs relative to said platform such that said at least one tubular member is raised from the sea bottom;

towing said platform, and thus said plurality of legs and said at least one tubular element, to a position wherein said at least one tubular element is spaced directly above the desired location; and lowering said at least one of said plurality of legs relative to said platform until said at least one tubular element comes to rest on the sea bottom.

3. A method as recited in claim 2, wherein said step of arranging said at least one tubular element on the sea bottom further comprises causing a bottom end of said at least one tubular element to be pressed into the sea bottom.

4. A method as recited in claim 2, further comprising the step of detaching said at least one tubular element from said at least one of said plurality of legs after said at least one tubular element has come to rest on the sea bottom.

5. A method as recited in claim 2, wherein when said at least one tubular element is connected to said at least one of said plurality of legs, it is suspended downwardly from said at least one of said plurality of legs.

6. A method as recited in claim 1, wherein said step of arranging at least one vertically oriented tubular element on the sea bottom comprises arranging a plurality of vertically oriented tubular elements on the sea bottom at positions corresponding to positions at which a corresponding number of said plurality of legs are desired to be located.

7. A method as recited in claim 6, wherein said step of arranging a plurality of vertically oriented tubular elements on the sea bottom comprises connecting said plurality of tubular elements together with reinforcement elements such that said plurality of tubular elements are spaced apart in said predetermined manner.

8. A method as recited in claim 1, further comprising removing said platform, said plurality of legs and said at least one tubular member from said desired location by:

detachably connecting said at least one tubular element to said corresponding at least one of said plurality of legs;

raising said plurality of legs relative to said platform such that said at least one tubular element is raised from the sea bottom and said filling material, which was previously filled into said at least one tubular element, is dumped out of an open bottom end of said at least one tubular element onto the sea bottom; and towing said platform away from said desired location.

9. A method as recited in claim 8, wherein when said at least one tubular element is connected to said at least one of said plurality of legs, it is suspended downwardly from said at least one of said plurality of legs.

10. An apparatus comprising:

a platform having a buoyant deck and having a plurality of legs attached to and extending downwardly from said platform, said plurality of legs being vertically movable relative to said platform;

at least one tubular element adapted to be filled with a filling material; and means for detachably connecting said at least one tubular element to at least one of said plurality of legs in a manner that allows said at least one tubular element to be suspended form said at least one of said plurality of legs.

11. An apparatus as recited in claim 10, wherein said means for detachably connecting comprises a chain detachably connected between said at least one tubular element and said at least one of said plurality of legs.

12. An apparatus as recited in claim 10, wherein said means for detachably connecting comprises a wire detachably connected between said at least one tubular element and said at least one of said plurality of legs.

13. An apparatus as recited in claim 10, wherein said at least one tubular element comprises a plurality of tubular elements; and a reinforcement means is provided for connecting said plurality of tubular elements to one another in a predetermined spaced apart relationship.

14. An apparatus as recited in claim 13, wherein said predetermined spaced apart relationship of said plurality of tubular elements corresponds to a predetermined spaced apart relationship between said plurality of legs.

15. An apparatus as recited in claim 10, wherein said at least one tubular element has two open ends.

* * * * *